United States Patent [19]

Colgate et al.

[11] Patent Number: 4,681,643

[45] Date of Patent: Jul. 21, 1987

[54] FAST BURNING PROPELLANTS

[76] Inventors: Stirling A. Colgate, 4616 Ridgeway, Los Alamos, N. Mex. 87544; George E. Roos, P.O. 284, Burns Flat, Okla. 73624

[21] Appl. No.: 538,578

[22] Filed: Oct. 3, 1983

Related U.S. Application Data

[63] Continuation-in-part of Ser. No. 220,975, Dec. 29, 1980, abandoned.

[51] Int. Cl.[4] ..... C06B 45/02

[52] U.S. Cl. ..... 149/21; 149/2; 149/43; 149/44; 149/46; 149/61; 149/63; 149/65; 149/72; 149/73; 149/76; 149/77; 149/79; 149/94; 149/95; 149/96; 149/97; 149/110; 149/111; 149/112; 149/113; 149/114; 149/115

[58] Field of Search ..... 149/2, 21, 110–115, 149/43, 44, 46, 61, 63, 65, 72, 73, 76, 77, 79, 94, 95, 96, 97

[56] References Cited

U.S. PATENT DOCUMENTS

| | | | |
|---|---|---|---|
| 3,673,286 | 6/1972 | Remaly et al. | 149/110 X |
| 3,725,154 | 4/1973 | McCulloch et al. | 149/110 X |
| 3,986,909 | 10/1976 | Macri | 149/5 X |
| 3,995,559 | 12/1976 | Bice et al. | 149/15 X |
| 4,038,112 | 7/1977 | Asaoka | 149/110 X |

*Primary Examiner*—Stephen J. Lechert, Jr.
*Attorney, Agent, or Firm*—Brumbaugh, Graves, Donohue & Raymond

[57] ABSTRACT

A solid or semisolid propellant comprising grains of propellant or propellant components bonded together so as to create voids within the propellant volume, said grains bonded together with sufficient strength to substantially delay the fluidization of the propellant by the onset of Taylor unstable burning, said propellant having a rapid burn rate below that associated with Taylor unstable burn. In another embodiment, the grains are held within and the voids are filled with viscous fluid binder such as a petroleum oil, said binder functioning to hinder Taylor unsatable burning and yet permit very rapid burning within the propellant volume.

33 Claims, No Drawings

FAST BURNING PROPELLANTS

This application is a continuation-in-part of application Ser. No. 06/220975, filed 12/29/80, now abandoned.

BACKGROUND OF THE INVENTION

The acceleration of rockets by the use of propellants is a well known technology. When propellants are used to accelerate vehicles into space, the rocket acceleration must be large compared to gravity (5 to 10 times g) so that impulse (force times time) is not wasted against gravitational force. When a rocket is in orbit or otherwise substantially uninfluenced by gravity the acceleration may be much smaller because gravity is no longer a limitation. Military rockets, on the other hand, must accelerate extremely rapidly, yet often the structure of the vehicle or the propellant composition limits the practical acceleration to a range of from 100 to 1000 g.

Rockets also find use in the rocket accelerated rod apparatus (RAR) such as is described in U.S. Pat. No. 3,509,821 for rapid penetration into dense media such as rock or metal. In RAR applications, an acceleration of several $\times 10^4$ g is required if the rod is to be used for commercial applications of boring holes in rock or ground. The high acceleration is required so that the stand-off distance required for the rocket-rod to attain the required penetration velocity can be reasonably small, e.g. 10 meters. A typical velocity required for substantial penetration is approximately 2000 meters per second with the result that the acceleration (within a distance of about 10 meters) is approximately 20,000 g. Conversely, the time of acceleration of burning time of the propellant is very short, e.g. $t=2\ d/v \simeq 10^{-2}$ seconds. Therefore there is a need for very fast burning propellants for rapid acceleration of projectiles for commercial uses.

In U.S. Pat. No. 3,616,855, which relates to the bulking and caving of underground ore bodies, a solid propellant is used to heave the ground after prestressing the formation by injecting an appropriate settable propping material. In such applications of earth fracturing (which is a form of bulking) there also exists a need for particular propellant burn properties. As discussed in U.S. Pat. No. 3,616,855, the propellant should burn (i.e. form the bulking or fracturing gas) in a time that is a small multiple (e.g. 2 to 10 times) of the dynamic time of the system. In this regard, it is not desired to shock the formation because this compacts the rock and wastes energy that would otherwise be used to lift it and form fractures. Fracturing with detonating explosives have shown that the shock wave in general compacts the ground or rock and does not in general open new fractures. While a slower gas release is thus desired, too slow a release results in the gas or fluid being lost into the formation. Hence the gas should be released within a period of approximately 2 to 10 times the dynamic time of the system.

A typical case is a well 3500 feet (1 km) deep. The time for a compression wave to reach the surface and return, i.e. the dynamic time, is roughly 2 seconds for a formation having a sound speed of 1 km $sec^{-1}$. Hence the gas release time from a preferred fracturing or bulking propellant should be 5 to 10 seconds.

The placement of the propellant will be within the bore hole, for example a bore hole 8 inches in diameter and 1200 feet or 300 meters in length. The propellant must burn a length of 300 meters in 20 seconds, or a burn velocity of 15 meter $sec^{-1}$. This also is in the range of burn velocity that is the objective of the present invention, but not available in conventional propellants.

There are thus two circumstances where a fast burning propellant is needed for useful purposes: fast rocket acceleration and underground well fracturing. In both cases the burn rate and hence the minimum pressure of the burning gases is roughly the same, namely several hundred MPA or 10 to 20 thousand PSI. This higher pressure is the result of the mass flow times gas velocity, or the time rate of change of momentum of the combustion gases. It is the useful pressure for either accelerating the rocket, or forcing the combustion gases into the rock for fracturing. Hence the high pressure of combustion is a necessary and useful result of a fast burning propellant. The magnitude of the pressure is determined by the geometry or confinement of the burn. It is this geometry or confinement that leads to two different mechanisms of fast burning propellants of this disclosure.

SUMMARY OF THE INVENTION

The propellants according to the present invention are solid propellants, since liquid propellants require pumps and plumbing. At high burn rates, pumps and plumbing become too massive.

The classical method for obtaining a fast burning solid propellant is to cast the solid propellant in a shape called a "grain" that has a large surface to volume ratio. A solid propellant burns at a rate dependent upon the pressure. This rate is proportional to:

$$(\text{pressure})^{gamma}$$

where gamma $<1$ for stable burn, and typically at a surface, gamma $\sim \frac{1}{2}$.

Hence one might think that merely going to very high pressure by the constriction of a nozzle would allow all desired burn rates. This is not true for two reasons:

(1) the required high pressure (e.g. 1000 atmospheres or 14,000 PSI) to obtain a typical burn rate of about 20 cm $sec^{-1}$ with a conventional propellant would require a casing strength (and hence weight) far too great—e.g. equal to the propellant weight—for a useful rocket. Of course, even greater casing weights would be required if burn rates substantially in excess of 20 cm $sec^{-1}$ and contemplated by the present invention (i.e. up to about $10^4$ cm $sec^{-1}$) were to be obtained.

(2) Monopropellants do not have a constant factor gamma in the above equation and if pressure is high enough the desired burn or deflagration turns into a detonation of such high velocity that the rocket would be destroyed.

Thus both practical weight and burn instabilities prohibit normal stable fast propellant burn with conventional propellants. Therefore, as a practical matter, the fast burn rates achievable according to the present invention must be achievable with pressures not exceeding about 1000 atmospheres, and usually not exceeding a tenth of that.

Hence in current practice if one desires all the propellant to burn in a short time, one makes a large surface area with thin webs of propellant. Burning then proceeds from both sides of the thin web.

For example if the burn time is to be $10^{-2}$ seconds for a propellant that burns at 5 cm $s^{-1}$, then the web thickness must be 1 mm. This is a thin web for a large rocket. This geometry, where the propellant is fluted in cross section, is also chosen such that the burning area remains roughly constant during the course of burning, so that the rate of production of combustion gases remains roughly constant.

If all the grain area is ignited at once, the burning will penetrate the webs rapidly and hence consume the propellant rapidly. The rocket casing and nozzle must confine the burn pressure. The nozzle converts the pressure to exhaust velocity and hence impulse.

The principal limitation of the thin webs of the standard grain geometry is the mechanical strength of the webs. If they are too thin, they cannot support the stress of the velocity of the high pressure combustion gases. The webs break and chunks of burning propellant are blown out the nozzle. This may choke the nozzle, lead to too rapid burn, and blow up the rocket. Hence there is a major requirement to produce a geometry for fast stable propellant burn.

The object of this invention is to disclose two geometries to achieve this objective: the first is end-burning of controlled size "chunks" of glued propellant, and the second is the controlled Taylor unstable burning of a viscous semi-solid semi-liquid propellant.

These two mechanisms relate to one another. Taylor instability comes about because of a differential pressure across a density discontinuity, i.e. the acceleration of a heavy fluid by a light one. In the case of propellant burn the combustion gases are the low density fluid and the propellant is the heavy fluid. The uncontrolled growth of a Taylor instability at a burning propellant surface leads to an uncontrolled increase of burning area and hence uncontrolled increase of pressure. This explodes the rocket casing. It may initiate detonation, i.e. converts propellant burn, a deflagration, to the explosive energy release of detonation. Hence uncontrolled Taylor instability growth is to be avoided for these purposes.

Taylor instability is damped by viscosity and prevented entirely by strength or rigidity of materials. The reason for solid propellants is to prevent the growth of Taylor instability at the burning surface. This disclosure is concerned with both the rigid case as well as the controlled growth of viscosity.

A rigid propellant is usually formed in a grain and the limit of burn rate is set by the thickness of the webs. Here we describe another method of obtaining a high burn rate using a rigid propellant. According to the invention, a propellant is provided which is comprised of near-uniform size particles—i.e. particles having less than about 20% size variation, and preferably less than about 10% size variation. By thus controlling the size variation of the respective particles, the size of the voids created when the particles are glued together (e.g. as by gluing them over approximately 20% of their surface area) are likewise controlled and of near-uniform size. Depending upon the shape and size of propellant particles chosen, the void size can be easily controlled and a void volume of from 10% to 50% of the total propellant volume can be maintained.

In one typical case the particles in a useful example are 0.2 cm (2 mm) diameter spheres glued over 20% of their surface area. The resulting glued structure results in a very strong rigid matrix. The matrix is so strong that the high pressure of burning does not crush the matrix. Instead it stably supports a high pressure—pressures of several hundred MPA, 10,000 to 20,100 PSI. Hence once the glued structure is ignited, the burn front progresses through the structure without breaking or crushing the propellant. The ignition of the structure starts at a surface and the controlled, near-constant size of the interconnected voids between particles allows the burning gas to propagate the ignition flame into the matrix. This flame progression is controlled by both the tortuosity of the surface area and by the voids between particles or spheres of propellant. By properly controlling the ignition properties, the void size, and the grain size, the flame front speed in the matrix can be controlled and hence the ignition rate of the matrix. The grain must be consumed in the time the flame front passes by. Hence the grain size must be controlled as well as the void size.

A given grain must be consumed in the time for the flame front to propagate the flame front's own width. Hence the size of the grain is determined by the propellant's burn properties, void spaces and flame propagation. Typically the burn velocity is 100 to 1000 cm $sec^{-1}$. The solid propellant burn rate might be 5 cm $sec^{-1}$ at the burn pressure determined by the nozzle area.

The flame front width is determined by the void spaces and ignition properties and typically might be about 5 cm. Thus the burn time per grain might be 0.05 to 0.005 seconds. Therefore the grain radius would be 0.25 to 0.025 cm (0.5 to 0.05 cm diameter). The 0.2 cm diameter spheres referred to above fall within this range. The result is a fast burning propellant where the burn front is a finite thickness or penetration into the structure.

It is important to note in this regard that the present invention differs from previously known sponge or foam compositions. Such sponge or foam compositions normally contain voids of non-uniform size which comprise from 95% to 98% of the propellant volume, and as such are known to burn at an uncontrolled rate substantially faster than that contemplated by the present invention. While such compositions perform satisfactorily as ignitors for other higher density propellants, they lack the density (and hence the ability to provide sufficient impulse) and controlled burning characteristics (due to the lack of strength of the foam and the wide disparity in particle size and void size) required of a true propellant.

The second method of making a fast burning propellant is to control the viscosity of the solid propellant. Viscosity determines the rate of Taylor unstable growth and hence determines the rate of new area of the burning front. Viscosity stabilizes small wave lengths and prevents them from growing. For a given viscosity, surface acceleration, and density ratio only wave lengths larger than a given size will grow. If the lateral extent of the burning front were infinite, then larger wave lengths could grow and the area of burning could increase without limit. On the other hand if the propellant is confined in a tube of diameter D, then the largest wave length that can grow is limited to D.

Hence if the largest wave length that can grow is the diameter, and the growth of smaller wave lengths is limited by viscosity, a combination can be chosen such that the rate of production of new area by Taylor instability is limited.

As noted above, the phenomona known as Taylor unstable burning occurs when a heavy fluid is accelerated by a light fluid and an instability takes place at the interface whereby the light fluid interpenetrates the heavy fluid with "fingers" of penetration (e.g. as will occur if one attempts to support water with air). If the density difference is large, the depth of penetration is a fraction of (e.g. $\frac{1}{3}$) the distance the whole mass moves during acceleration. In the usual rocket the hot (light) exhaust gases push on the high density propellant. The only reason these two systems do not mix by Taylor instability is that the heavy meterial, the propellant, is semirigid and does not "flow" like a fluid.

However, it has been found that there is a more rapid burning of solid propellant when no binder is used in a conventional solid propellant mixture so that the mixture of, for example, $KClO_4$ and Aluminum is "fluidized" by the reacting gases and fingers of flame penetrate into the propellant. This has the result of causing a much faster overall burn of the fuel. The problem with this mode of propellant burn is that it is too fast and approximates an uncontrolled deflagration. It has been found that the Taylor unstable mixing progresses into the propellant at a fraction ($\leqq 1/10$) of the sound speed of the propellant cumbustion gases. (These experiments were performed with powdered propellants.) Since the sound speed is large $C_s \leqq 1.5\times10^3$ m sec$^{-1}$, the resultant burn velocity 1 to $2\times10^2$ m sec$^{-1}$ is too great for practical use. This rapid burn generates too high a pressure (about $10^4$ atmospheres, 140,000 PSI) for the feasible structural strength of any rocket casing.

We demonstrate our understanding of the phenomena by calculating the above experimental result. One can calculate the expected burn rate in Taylor unstable burning by assuming that the Taylor instability occurs only when the in situ burning has proceeded far enough to fluidize the propellant by generating enough high temperature gas to fill the interstices to a pressure equal to or greater than the free surface pressure of the burn front. This fluidized propellant then allows Taylor unstable mixing to occur at a mean velocity that is a fraction, e.g. $\frac{1}{2}$ to $\frac{1}{3}$, of the combined (propellant solids and fluidizing gas) sound speed of the mixture. If the mass fraction of the burn necessary to reach this pressure is $f_{mass}$, then the combination sound speed of the mixture becomes $$C_{mix}=C_s f_{mass}^{\frac{1}{2}}$$

The sound speed of the mixture is increased proportionally to the square root of the increase in the effective density of the mixture. If $f_{mass}$ equals 1/10, then the burn rate, R, becomes $$R\simeq\tfrac{1}{3}C_{mix}$$

On the other hand the burn rate R leads to a pressure $P_{burn}$ for a free surface burn, i.e. without a nozzle, of $$P_{burn}=R\rho v_{exhaust}$$

where $v_{exhaust}\simeq$the specific impulse times g which is the velocity corresponding to the conversion of the internal energy to kinetic energy. $\rho$=density of propellant. Therefore $$v_{exhaust} = C_s\left[\frac{2}{\gamma(\gamma-1)}\right]^{\frac{1}{2}}$$

-continued and $$P_{burn} = F_{mass}^{\frac{1}{2}}\rho C_s^2\left[\frac{2}{\gamma(\gamma-1)}\right]^{\frac{1}{2}}$$

On the other hand the fraction of propellant that must be burned to reach a given pressure in the interstices (i.e. void volume) of a heterogeneous propellant of fractional void volume $f_{void}$ (assumed small) becomes $$f_{mass}\simeq\frac{f_{void}P_{burn}}{\rho C_s 2/\gamma}$$

Here, if the void volume were 1%, then the mass fraction, $f_{mass}$, that would have to be burned to reach a pressure $P_{burn}$ equal to the maximum confined pressure $\rho C_s^2/\gamma$, would be also 1%. Thus $$f_{mass}^{\frac{1}{2}} = f_{void}\left(\frac{2\gamma}{\gamma-1}\right)^{\frac{1}{2}}$$

and hence $$R = (C_s/3)\,f_{void}\left(\frac{2\gamma}{\gamma-1}\right)^{\frac{1}{2}}$$

For typical values of a propellant of $KClO_4$ and powdered aluminum, $C_s\simeq\frac{1}{2}v_{exhaust}\simeq1.2\times10^3$ m sec$^{-1}$, $\gamma\simeq1.4$ so that $$\left(\frac{2\gamma}{\gamma-1}\right)^{\frac{1}{2}} = 2.7\,R = 10^3 f_{void}\text{ m sec}^{-1}.$$

For a fairly wide distribution of particle size, $f_{void}$=20% so that $R\simeq2\times10^2$ m sec$^{-1}$. This is just in the range observed. This results in too large a pressure for practical application, $\simeq$7500 atmospheres, or 110,000 PSI.

The fastest solid propellants burn at about 0.1 m sec$^{-1}$ while Taylor unstable burning burns at a rate approximately $10^3$ times faster. It is thus the object of this invention to provide a means to control the burn rate of a solid or semisolid propellant to values intermediate between these extremes i.e. from 10 to about $10^4$ cm sec$^{-1}$ and preferably from about 10 to about $10^3$ cm sec$^{-1}$. This is accomplished according to either of two preferred embodiments, one of which prevents the onset of Taylor unstable burning by forming a rigid strong matrix of glued, near-constant size particles or chunks, the other of which imposes a velocity limitation in the nonlinear phase of Taylor instability growth.

Looking to the first embodiment, a conventional powder propellant when packed together yields a structure of mass which contains voids, typically comprising from 10% to 50% of the volume of the structure or mass. As pointed out above, it is the flow of gas through the interstices of the inter-grain void spaces that allows the "fluidization" of the propellant and the very rapid Taylor unstable burn. In this regard, it is important to note that with respect to conventional solid propellants, voids are purposely carefully eliminated for this very reason, i.e. voids will normally permit the onset of Taylor instability.

According to the present invention, however, the voids are retained (preferably comprising from 10% to 20% of the propellant volume), but one grain is glued rigidly to the next so that the fluidization process cannot take place. Thus the Taylor unstable burning mode also cannot take place. Gas will flow to a limited extent between the grains, but the large increase in the area of unstable burning will not take place—unless and until the glue strength disappears due to melting or burning of the glue. The thicker the glue bond, grain to grain, and the more refractive the glue, then the longer it will take for the grain to become free and enter the fluidized fraction of the propellant. In other words the stronger the glue the slower the burn. The slowing down of the burn rate below that associated with free particle Taylor unstable burn is desired.

As pointed out above, foamed propellants such as are used for fast ignition will not work as a fast propellant, one because the density is so low that only a very small mass of propellant is possible inside a casing, and secondly the strength of the foam is too small or weak to support high pressure, high stress rapid burn, and third the velocity of burn is uncontrollably high due to the wide dispersion in particle size.

The second embodiment differs from the first in that the "glue" is a viscous fluid, such as a heavy oil, which fills the voids between the grains. This viscous fluid serves not to delay the actual onset of Taylor instability (such as is imposed by the time it takes the glue to lose strength by melting or burning), but instead permits the continuous surface changes during burning normally associated with Taylor instability but at a substantially slower rate (i.e. as mentioned above a velocity limitation is imposed upon the nonlinear phase of Taylor instability growth rate due to the viscosity and shear stress of the fluid). With respect to this second embodiment, a burn rate of from about 10 to about 10 m $sec^{-1}$ is preferred.

Unlike the first embodiment of the invention, wherein substantially uniform particle size is important, the second embodiment permits the particle size to vary substantially. Typical particle diameters resulting from conventional manufacturing methods and usable in the present invention range from about one micron to about one mm.

This second embodiment is particularly useful in well fracturing because the large quantity of propellant that must be used calls for a relatively low cost propellant. In addition, because the propellant is placed at great depth, considerable pressure compacting of the propellant may occur due to the length of the column as well as fluid pressures. Hence it may be impractical to use void-containing propellants that are glued particle to particle such as are contemplated by the first embodiment.

DESCRIPTION OF EXEMPLARY EMBODIMENTS

EXAMPLE 1

Cracked black powder grains were screened to 1/16 to 3/32 inch size such that the grain size distribution was relatively narrow—i.e., a size distribution to within 50%. The grains were then coated with a glue that also functions as a propellant. The glue was made by dissolving a high nitrogen nitrocellulose, i.e., 12 to 12.5% nitrogen, in a solvent such as acetone, ether, or ether alcohol. In initial trials, the mass fraction of combustible glue was roughly 5 to 10% although other percentages will give different burn rates. The coated grains were then packed in an open end tube—a rocket casing 10 cm long—and allowed to dry (i.e. the solvent of the glue was allowed to evaporate). When the dried and cured propellant was ignited, it burned stably in about a tenth of a second. This gives a burn rate of 100 cm $sec^{-1}$. A smaller mass fraction of glue—say 1%—increases this burn rate by another factor of 10. If a heterogeneous propellant like $NH_4ClO_4$ or $KClO_4$ plus Aluminum is used, the glue can take the form of a combustible hydrocarbon such as epoxy or urethane. The ratio of glue to aluminum to oxidizer should be such as to create a stoichiometric balance for highest performance although a slower burn rate may require a compromise of performance. It will also be appreciated by one skilled in the art that other common oxidizers may be used according to the invention such as the compounds having Na, K, and $NH_4$ as the cation and $NO_3$, $ClO_3$ and $ClO_4$ as the anion.

EXAMPLE 2

In another embodiment the monobase or double base powders (Nitrocellulose or nitrocellulose plus nitroglycerine) may be pre-formed into balls all accurately the same size, or more complicated shapes, grains, as is well known in military cannon technology. The simplest shape, called ball powder, is ideally suited to the present concept of a controlled fast-burning propellant. A ball powder can be made of a predetermined cut of different size balls so that different packing fractions are achieved, i.e. different ratios of void space to propellant space. In addition the maximum ball size determines the burn rate as an additional delay time to the glue melting time. In this case the glueing of such a matrix is relatively simple. In one case the prepacked powder can be wetted with a solvent like ether or acetone or other well known solvent for nitrocellulose and the solvent allowed to partially dissolve the grains, e.g. balls, for a predetermined length of time. The solvent is then allowed to drain out and the dissolved surfaces of the grains then act as their own glue.

The subsequent evaporation of the solvent from within the volume of the propellant is facilitated by the fact that the void space interconnects the whole volume and hence air transport of the solvent can readily take place.

Alternately, for slower burning of the same propellant at a high chamber pressure, for example greater than 1000 PSI, it may be desirable to use a thicker glue layer filling ½ the void space. Then the balls should be precoated with glue before packing. The glue in this case preferably is a propellant also so that it adds to the reactive mass. Again nitrocellulose dissolved in solvent is an advantageous choice. However there may be circumstances where high specific impulse may not be the only consideration, but instead a high volume of gas may be desired. Then a glue that gives a high volume of inert gas when heated such as polycarbonates or ureas could be advantageously used.

EXAMPLE 3

The particular advantage of heterogeneous propellants where oxidizer and fuel are physically separated in the matrix—such as $NH_4NO_3$, Thiokol rubber, and aluminum—is that they are much safer to handle and transport and are considered practically immune to detonation. Accidental ignition is however possible and, while not necessarily as catastrophic as a detonation, is nonetheless serious. Hence, there is a need to make safer very fast burning heterogeneous propellants. Again the heterogeneous propellant can be preformed into grains and then the grains glued to one another in a fashion entirely analagous to the homogeneous propellants. The standard heterogeneous propellant that uses a polymerized rubber, for example Thiokol, is not as easily dissolved in place as nitrocellulose, and so the preferred embodiment in this case requires that a glue be added to the grains before casting. Again the pre-polymerized rubber combined with fuel (aluminum) is one choice but many self-polymerizing glues with oxidizers added like epoxy and $KClO_4$ or urethane and $KClO_4$ are feasible.

EXAMPLE 4

In this example the propellant is considered to be a heterogeneous mixture that is fluidized with a viscosity $\eta$. The scale of the heterogenity is the grain size $\delta$ of oxidizer or oxidizer-fuel grains. The instability growth is already initiated at large amplitude by the different properties of density and temperature of the burning grain boundaries and the viscous fluid. If the burn pressure is P, then the differential acceleration, $\Delta a$, will be of the order $$\Delta a \simeq \frac{\Delta\rho}{\rho} \frac{P}{\rho}$$

where $\rho$ is the average density and $\Delta\rho$ the density difference between grains and fluid. The differential acceleration will be balanced by a shear stress from the velocity gradient, $(\Delta v/\delta)$ in the viscous fluid of viscosity $\eta$.

The viscosity shear stress is approximately $2\eta(\Delta v/\delta)$ so that balancing of forces yields $$(\Delta a)\,\rho = 2\eta(\Delta v/\delta)$$

or $$\Delta v = \frac{\delta\rho}{2\eta} \frac{\Delta\rho}{\rho} \frac{P}{\rho}$$

Choosing typical values, the typical grain size of the cheapest commercial oxidizer, $NaNO_3$, is $\delta \simeq 1$ mm. The density contrast between the cheapest viscous fluid fuel, i.e. petroleum oils and tars, and $NaNO_3$ is $\Delta\rho/\rho \simeq \frac{1}{3}$. The typical pressure required for fracturing a well 1 km deep would be 300 atmospheres. Then the intergrain or instability flow velocity would be $$\Delta v \simeq 5\times 10^4/\eta \text{ meters sec}^{-1}.$$

This formula of course does not hold unless $\eta$ is quite large such that $\Delta v$ is much less than sound speed, e.g. $\Delta v << 2\times 10^3$ meter $sec^{-1}$. Otherwise the assumption of neglecting inertial forces in favor of viscous forces would not apply. However, because a relatively slow speed (compared to sound speed) of $\Delta v \simeq 10$ to 20 meter $sec^{-1}$ is desired, a viscous fluid binder or fuel of $\eta \simeq 3000$ poise will be necessary. Since SAE 50 automotive oil has a viscosity at 100° F. of roughly 1/10 this value (260 poise) it can be seen that the viscous fluid should have a viscosity between a typical road tar and bunker C fuel oil. This is fortunate because for the proposed use these residual oils are the least expensive.

Therefore a typical embodiment of a viscous solid propellant for oil well fracturing or underground bulking could combine the cheapest oxidizer $NaNO_3$ blended with a residual oil such as to form the products $NaO+N_2+H_2O+CO_2$. In addition, in order to ensure burning of the relatively refractory oxidizer $NaNO_3$, one can increase the flame temperature by the addition of powdered Aluminum or a similar high energy fuel. In this case, depending upon the stoichiometric fraction, some of the heavy oil will be just vaporized rather than burned. The effectiveness of this vaporized oil as a fracturing gas is comparable to the combustion product gases. This then becomes a preferred mixture.

If the heavy oil has a low value of H to C of $\cong 1$, then an excess of fuel may yield less oxygen and the products CO, $CO_2$ and $H_2$. This is slightly preferred in fracturing because the steam ($H_2O$) will give up its heat to fractures and liquefy to water, thereby reducing the useful gas volume for fracturing.

EXAMPLE 5

The limiting viscosity of a viscous binder is a solid. Coal will not re-form with heat, but as a pulverized solid it can give a fast burning rate as a powder depending on particle size. The natural bitumen "Gilsonite" has the peculiar properties that it can be ground as a solid, but then partially reformed as a plastic and so a variable degree of binding can be achieved between oxidizer and fuel particles. This also can lead to medium to fast burning rate propellant just as the glued grain example.

EXAMPLE 6

A typical embodiment of well fracturing with a fast burning propellant starts with the completion of a well, for example 8" in diameter although larger or smaller diameters are entirely feasible. The volume of propellant to be burned is determined by the desired fracture system. Typically volumes of very large fracture or stimulation operations are of the order of 10,000 barrels or 2000 cubic meters. A gasified solid propellant expands to a volume of roughly 100 times the propellant volume to a typical formation pressure of 200 atmospheres (3000 PSI).

The energy content of the propellant is roughly $5\times 10^{10}$ ergs/gm giving rise to a pressure of $\simeq 10^{11}$ dynes $cm^{-2}$. The adiabatic expansion of the propellant gases from $10^{11}$ dynes to 200 atmospheres, or $2\times 10^8$ dynes $cm^{-2}$, results in a volume change of $(10^{11}/2\times 10^8)^{1/\gamma} \simeq 85$ fold. Since the density of the propellant is somewhat greater than unity, the volume of gases should be roughly 100 times the volume of propellant. The expansion of the gases may not be entirely adiabatic depending upon the back pressure in the burning region. However, if the expansion is at constant enthalpy, the volume of gas will be greater up to the ratio $V_1/V_2 = P_1/P_2 \simeq 500$. Hence the adiabatic approximation is the lower limit of available fracture volume.

In the above circumstances, the initial propellant charge of 10 $m^3$ should be the equivalent of 1000 $m^3$ or 5000 barrels of pumped fracture fluid.

Next a string is set with an igniter at the base (preferably Thermite or other high temperature burning igniter) and with the maximum diameter that will go down the hole—e.g. 8" in the present example. The strength of the string must be great enough to contain the propellant in place. In this example L=Vol/area≃300 meters assuming a pipe string wall thickness of $\frac{1}{4}$", enough to hold the added fracture pressure during the transient burn period and assuming a competent formation as backup of the well liner. The top of the string can be closed off with a packer or stemmed with a weak cement or sand if later drill back is expected. The advantage of the weak cement or sand stem is that in the event of a blow-out from unforeseen reasons the propellant and cement particles could vent to the surface with lessened danger to personnel in the immediate vicinity.

The propellant is mixed down hole with preheated viscous oil and oxidizer. In this regard, $NaNO_3$ is preferred as it is the cheapest oxidizer. By mixing down hole, one avoids the danger of preignition and possible danger to personnel.

EXAMPLE 7

In a less preferred embodiment, one might consider pumping the propellant slurry through a nozzle down hole during burning at a velocity sufficiently great so that the burn front does not climb up the injection string. In this way one could avoid the difficulty of setting a casing string, and instead use cheaper, smaller diameter tubing.

However, certain difficulties can be foreseen with this approach. First, by the previous analysis the viscosity of the oil must be low for rapid pumping, yet high in order to control the burning rate of the propellant. The high viscosity of 3000 poise essentially precludes rapid pumping because of viscous pipe losses. A lower viscosity will give too high a burn rate. Finally if a slurry of pre-mixed fuel and oxidizer is pumped at a high pressure, there is always the danger of ignition by friction in the pump valves and piping. This could lead to an explosion. Hence the propellant is preferably mixed in the relative safety of down hole and burned in situ.

We claim:

1. A solid or semisolid propellant comprising grains of propellant or propellant components bonded together so as to create voids within the propellant volume, said grains being of near-uniform size such that they have less than about a 20% size variation between the largest and smallest grains, said voids comprising from about 10% to about 50% of the propellant volume, said grains bonded together with sufficient strength to substantially delay the fluidization of the propellant by the onset of Taylor unstable burning, said propellant thereby having a rapid burn rate of from about 10 cm $sec^{-1}$ to about $10^4$ cm $sec^{-1}$.

2. A propellant according to claim 1 wherein said grains have less than about a 10% size variation between the largest and smallest grains.

3. A propellant according to claim 2 wherein said voids comprise from about 10% to about 20% of the propellant volume.

4. A propellant according to claim 3 wherein said grains are bonded together with a glue.

5. A propellant according to claim 4 wherein said glue also functions as a propellant or propellant component.

6. A propellant according to claim 5 wherein said glue is nitrocellulose.

7. A propellant according to claim 4 wherein said grains are black powder.

8. A propellant according to claim 4 wherein said grains comprise separate grains of oxidizer and grains of fuel.

9. A propellant according to claim 8 wherein said grains of oxidizer are selected from the group consisting of $NH_4NO_3$, $NH_4ClO_3$, $NH_4ClO_4$, $NaNO_3$, $NaClO_3$, $NaClO_3$, $KNO_3$, $KClO_3$ and $KClO_4$ and said grains of fuel are selected from the group consisting of hydrocarbon and aluminum.

10. A propellant according to claim 3 wherein said grains are substantially spherical in shape.

11. A propellant according to claim 1 wherein said propellant grains are a monobase or double base propellant selected from the group consisting of nitrocellulose and nitrocellulose in combination with nitroglycerine.

12. A propellant according to claim 11 wherein said propellant grains are bonded together by bridges of said propellant, said bridges having been formed by the use of a solvent for the propellant that has first been permitted to partially dissolve the surface of the grains such that when the solvent is removed said grains are bonded together by bridges of said propellant.

13. A propellant according to claim 11 wherein said grains are bonded together by a glue, said glue comprising nitrocellulose which has been dissolved in a solvent, and wherein said solvent has been removed by drying after the grains are glued together.

14. A propellant according to claim 11 wherein the grains are bonded together with a glue that yields a high volume of inert gase when burned.

15. A propellant according to claim 14 wherein the glue is selected from the group consisting of polycarbonates and ureas.

16. A propellant according to claim 1 wherein said propellant is heterogeneous and comprises grains of $NH_4NO_3$, polymerized Rubber and Aluminum.

17. A propellant according to claim 16 wherein said grains are bonded together with a glue, said glue selected from the group consisting of epoxy in combination with $KClO_4$ and urethane in combination with $KClO_4$.

18. A propellant according to claim 1 wherein said propellant has a burn rate of from about 10 cm sec to about $10^3$ cm $sec^{-1}$.

19. A propellant according to claim 1 wherein said grains have a diameter of from about 0.5 cm to about 0.05 cm.

20. A propellant comprising grains of propellant or propellant components held within a fluid binder, said binder being sufficiently viscous so as to hinder the fluidization of the propellant volume by the onset of Taylor unstable burning and yet sufficiently fluid so as to permit the binder to flow during burning due to unequal stresses in the propellant volume and thereby to permit the surface shape of the propellant to continuously change during burning, said surface shape change during burning being sufficient to produce a burn rate of from about 10 m $sec^{-1}$ to 100 m $sec^{-1}$.

21. A propellant according to claim 20 wherein the binder is a petroleum oil.

22. A propellant according to claim 21 wherein the binder is selected from the group consisting of tar and bunker fuel oil.

23. A propellant according to claim 21 wherein the binder has a viscosity in the range between that of road tar and bunker C fuel oil.

24. A propellant according to claim 20 wherein the binder has a viscosity of at least 3000 poise.

25. A propellant according to claim 21 wherein at least some of the grains of propellant components are oxidizers.

26. A propellant according to claim 22 wherein at least some of the grains of propellant components are oxidizers.

27. A propellant according to claim 23 wherein at least some of the grains of propellant components are oxidizers.

28. A propellant according to claim 24 wherein at least some of the grains of propellant components are oxidizers.

29. A propellant according to claim 25 wherein at least some of the grains of propellant components are oxidizers selected from the group consisting of $NH_4NO_3$, $NH_4ClO_3$, $NH_4ClO_4$, $NaNO_3$, $NaClO_3$, $NaClO_4$, $KNO_3$, $KClO_3$ and $KClO_4$.

30. A propellant according to claim 26 wherein at least some of the grains of propellant components are oxidizers selected from the group consisting of $NH_4NO_3$, $NH_4ClO_3$, $NH_4ClO_4$, $NaNO_3$, $NaClO_3$, $NaClO_4$, $KNO_3$, $KClO_3$ and $KClO_4$.

31. A propellant according to claim 27 wherein at least some of the grains of propellant components are oxidizers selected from the group consisting of $NH_4NO_3$, $NH_4ClO_3$, $NH_4ClO_4$, $NaNO_3$, $NaClO_3$, $NaClO_4$, $KNO_3$, $KClO_3$ and $KClO_4$.

32. A propellant according to claim 28 wherein at least some of the grains of propellant components are oxidizers selected from the group consisting of $NH_4NO_3$, $NH_4ClO_3$, $NH_4ClO_4$, $NaNO_3$, $NaClO_3$, $NaClO_4$, $KNO_3$, $KClO_3$ and $KClO_4$.

33. A propellant according to claim 20 wherein said grains of propellant or propellant components are from about one micron to about one mm. in size.

* * * * *